US010584562B2

(12) United States Patent
Hughes et al.

(10) Patent No.: US 10,584,562 B2
(45) Date of Patent: Mar. 10, 2020

(54) MULTI-STAGE WELL ISOLATION

(71) Applicant: The WellBoss Company, Inc., Calgary (CA)

(72) Inventors: John Hughes, Calgary (CA); Ryan D. Rasmussen, Calgary (CA); James W. Schmidt, Calgary (CA)

(73) Assignee: The WellBoss Company, Inc. (CA)

( * ) Notice: Subject to any disclaimer, the term of this patent is extended or adjusted under 35 U.S.C. 154(b) by 0 days.

(21) Appl. No.: 15/923,942

(22) Filed: Mar. 16, 2018

(65) Prior Publication Data

US 2018/0252074 A1 Sep. 6, 2018

Related U.S. Application Data

(62) Division of application No. 14/409,120, filed as application No. PCT/CA2013/001072 on Dec. 20, 2013, now Pat. No. 9,995,111.

(Continued)

(51) Int. Cl.
*E21B 33/128* (2006.01)
*E21B 43/26* (2006.01)

(Continued)

(52) U.S. Cl.
CPC ..... *E21B 34/103* (2013.01); *E21B 33/1216* (2013.01); *E21B 34/14* (2013.01); *E21B 2034/007* (2013.01)

(58) Field of Classification Search
CPC ..... E21B 43/26; E21B 33/128; E21B 33/1285
See application file for complete search history.

(56) References Cited

U.S. PATENT DOCUMENTS 2,602,513 A 7/1952 Conrad et al.
2,857,972 A 10/1958 Baker (Continued)

FOREIGN PATENT DOCUMENTS

CA 1151536 A 9/1983
CA 1182393 A 12/1985

(Continued)

OTHER PUBLICATIONS

Halliburton Website showing ZoneGuard Openhole Isolation Packers.

(Continued)

*Primary Examiner* — Kenneth L Thompson
(74) *Attorney, Agent, or Firm* — Rao DeBoer Osterrieder, PLLC; John M. DeBoer

(57) ABSTRACT

A method is provided for multistage isolation and fluid treatment of a borehole, in which a first frac valve tool and a second frac valve tool are provided, a first packer is mounted downstream from the first frac valve tool, a second packer is mounted between the first frac valve tool and the second frac valve tool, a third packer is mounted upstream from the second frac valve tool, at least one of the first, second and third packers being a hydraulic set packer having a single packing element, the first frac valve tool being moveable between a closed and an open position, the second frac valve tool moveable between a closed and an open position; running the liner into a wellbore; hydraulically setting the single element packers; conveying means for moving the first frac valve tool to the open position; and forcing stimulation fluid out through the first frac sleeve tool.

4 Claims, 4 Drawing Sheets

Related U.S. Application Data

(60) Provisional application No. 61/745,123, filed on Dec. 21, 2012.

(51) Int. Cl.

| | |
|---|---|
| ***E21B 34/10*** | (2006.01) |
| ***E21B 33/12*** | (2006.01) |
| ***E21B 34/14*** | (2006.01) |
| *E21B 34/00* | (2006.01) |

(56) References Cited

U.S. PATENT DOCUMENTS

| | | | | |
|---|---|---|---|---|
| 2,997,107 | A | 8/1961 | Lynes | |
| 3,036,639 | A | 5/1962 | Baker | |
| 3,229,767 | A | 1/1966 | Carter | |
| 3,285,343 | A | 11/1966 | Urbanosky | |
| 3,289,762 | A | 12/1966 | Schell et al. | |
| 3,306,362 | A | 2/1967 | Urbanosky | |
| 3,311,171 | A | 3/1967 | Castro | |
| 3,412,803 | A | 11/1968 | Stachowiak | |
| 3,587,736 | A | 6/1971 | Brown | |
| 3,706,342 | A | 12/1972 | Woolley | |
| 4,099,563 | A | 7/1978 | Hutchison et al. | |
| 4,745,972 | A | 5/1988 | Bell et al. | |
| 5,176,217 | A | 1/1993 | Luke et al. | |
| 5,277,253 | A | 1/1994 | Giroux et al. | |
| 5,472,049 | A | 12/1995 | Chaffee et al. | |
| 6,612,372 | B1 | 9/2003 | Freiheit et al. | |
| 6,907,936 | B2 * | 6/2005 | Fehr | E21B 33/124 166/387 |
| 7,306,033 | B2 | 12/2007 | Gorrara | |
| 7,735,549 | B1 | 6/2010 | Nish | |
| 7,779,908 | B2 | 8/2010 | Eriksson et al. | |
| 9,004,155 | B2 | 4/2015 | Chalker et al. | |
| 2002/0043368 | A1 | 4/2002 | Bell et al. | |
| 2003/0127227 | A1 | 7/2003 | Fehr et al. | |
| 2003/0132008 | A1 | 7/2003 | Hirth et al. | |
| 2003/0226659 | A1 | 12/2003 | Smith et al. | |
| 2003/0226660 | A1 | 12/2003 | Winslow et al. | |
| 2004/0118564 | A1 | 6/2004 | Themig et al. | |
| 2004/0129422 | A1 | 7/2004 | Themig | |
| 2005/0178552 | A1 | 8/2005 | Fehr et al. | |
| 2006/0090906 | A1 | 5/2006 | Themig | |
| 2007/0007007 | A1 | 1/2007 | Themig et al. | |
| 2007/0012460 | A1 | 1/2007 | Coronado | |
| 2007/0151734 | A1 | 7/2007 | Fehr et al. | |
| 2008/0011471 | A1 | 1/2008 | Hughes et al. | |
| 2008/0277110 | A1 | 11/2008 | Themig | |
| 2008/8314596 | | 12/2008 | Themig | |
| 2009/0008083 | A1 | 1/2009 | Themig et al. | |
| 2009/0071644 | A1 | 3/2009 | Themig | |
| 2009/0255690 | A1 | 10/2009 | Conner et al. | |
| 2009/0283280 | A1 | 11/2009 | Themig | |
| 2010/0065276 | A1 | 3/2010 | Fehr et al. | |
| 2010/0186970 | A1 | 7/2010 | Burnett et al. | |
| 2011/0100643 | A1 | 5/2011 | Themig et al. | |
| 2011/0127047 | A1 | 6/2011 | Themig et al. | |
| 2011/0259610 | A1 | 10/2011 | Shkurti et al. | |
| 2011/0278010 | A1 | 11/2011 | Fehr et al. | |
| 2013/0068484 | A1 | 3/2013 | Themig et al. | |
| 2013/0180718 | A1 | 7/2013 | Fehr et al. | |

FOREIGN PATENT DOCUMENTS

| | | | |
|---|---|---|---|
| CA | 2280003 | A1 | 8/1998 |
| CA | 2024347 | C | 5/2001 |
| CA | 2427017 | A1 | 6/2002 |
| CA | 2396242 | A1 | 2/2003 |
| CA | 2412072 | A1 | 5/2003 |
| CA | 2176669 | C | 12/2003 |
| CA | 2200257 | C | 1/2004 |
| CA | 2434346 | A1 | 1/2004 |
| CA | 2241027 | C | 4/2004 |
| CA | 2524330 | A1 | 11/2004 |
| CA | 2192013 | C | 2/2005 |
| CA | 2498987 | A1 | 8/2005 |
| CA | 2606184 | A1 | 11/2006 |
| CA | 2636195 | A1 | 7/2007 |
| CA | 2662406 | A1 | 3/2008 |
| CA | 2724375 | A1 | 6/2011 |
| CA | 2734420 | A1 | 12/2011 |
| CA | 2713684 | A1 | 2/2012 |
| CN | 201972655 | U | 9/2011 |
| EP | 791720 | A2 | 8/1997 |
| GB | 1012397 | | 12/1965 |
| WO | 200192682 | A1 | 12/2001 |
| WO | 2003002847 | A1 | 1/2003 |
| WO | 200354349 | A1 | 7/2003 |
| WO | 2003104610 | A1 | 12/2003 |
| WO | 2008154392 | A1 | 12/2008 |
| WO | 2009126450 | A1 | 10/2009 |
| WO | 2010151905 | A2 | 12/2010 |
| WO | 2011028404 | A2 | 3/2011 |
| WO | 2011037586 | A1 | 3/2011 |
| WO | 2012045168 | A1 | 4/2012 |

OTHER PUBLICATIONS

Baker Hughes Youtube Video showing FracPoint Openhole Fracture Completion System.

Compression Element Packer-Ares-Weatherford Literature.

Tryton Brochures on ISOPAC-I Single Element Packer and ISOPAC-II Dual Element Packer.

NCS Energy Services, NCS Multistage Unlimited Half-Straddle.

Resource Well Completion Technologies Inc., OH Open Hole Hydraulic Set Packer, dated Jan. 5, 2011.

Resource Well Completion Technologies Inc., CH Hydraulic Set Permanent Packer, dated May 27, 2011.

Canadian Association of Drilling Engineers/Canadian Association of Oilwell Drilling Contractors, Drilling Conference Guide, dated Mar. 12, 2011.

The Roughneck, Resource Well Completion Technologies—Zone Seeker & Zone Striker Reach Targets Effectively & Efficiently, dated Sep. 2012.

Business in Calgary, Canuck Completions Ltd., Unveils the New Isofrac II Multi-Stage Fracturing System, dated Sep. 2012.

Design and Installation of a Cost Effective Completion System for Horizontal Chalk Wells Where Multiple Zones Require Acid Stimulation, D.W. Thomson and M.F. Nazroo, prepared for publication at the 1997 Society of Petroleum Engineers (SPE) Production Operations Symposium, Mar. 9-11, 1997, SPE Paper 37482 ("Thomson Paper").

* cited by examiner

MULTI-STAGE WELL ISOLATION

CROSS REFERENCE TO RELATED APPLICATIONS

This application is a divisional of U.S. patent application Ser. No. 14/409,120 having 371 (c) date of Dec. 18, 2014, which is a national application based on International application No. PCT/CA2013/001072 having a filing date of Dec. 20, 2013, which claims the benefit of priority of U.S. Provisional Application No. 61/745,123 filed on Dec. 21, 2012, which applications (including description, claims, abstract and drawings) are hereby incorporated by reference into the present specification in their entirety.

FIELD OF INVENTION

The present invention relates to devices for multi-stage, horizontal well isolation.

BACKGROUND OF THE INVENTION

An important challenge in oil and gas well production is accessing hydrocarbons that are locked in formation and not readily flowing. In such cases, treatment or stimulation of the formation is necessary to fracture the formation and provide passage of hydrocarbons to the wellbore, from where they can be brought to the surface and produced.

Fracturing of formations via horizontal wellbores traditionally involves pumping a stimulant fluid through either a cased or open hole section of the wellbore and into the formation to fracture the formation and produce hydrocarbons therefrom.

In many cases, multiple sections of the formation are desirably fractured either simultaneously or in stages. Tubular strings for the fracing of multiple stages of a formation typically include one or more fracing tools separated by one or more packers.

In some circumstances frac systems are deployed in cased wellbores, in which case perforations are provided in the casing to allow stimulation fluids to travel through the fracing tool and the perforated casing to stimulate the formation beyond. In other cases, facing is conducted in uncased, open holes. In the case of multistage, open hole fracing it is often a challenge to effectively isolate sections of the formation. This is due to the uneven inner surface of the open wellbore and the difficulty of making sufficient sealing contact between the packing elements of the packers and the surface.

A number of packers are known in the art including swellable that comprise substances which react with hydrocarbons or water in the wellbore and are caused to swell. Swellable packers are dependent on sufficient exposure of the swellable substance to wellbore fluids that trigger swelling. The process of full packing off of the section to be fraced can take days to weeks using such swellable packers. Inflatable packers are also known in the art and are activated by inflation of packing elements with a gas or air.

Hydraulic packers are typically defined as packers in which the packing elements can be activated by hydraulic pressure from wellbore fluids. Hydraulic packers have also been used in some open hole cases, however they typically require multiple packing elements per packer to provide sufficient contact with the open hole inner wellbore surface and to provide proper isolation for multistage packing.

A need therefore exists in the art for packers that are simple in construction, small in size and effective at packing off in open hole wellbores.

SUMMARY OF THE INVENTION

In one aspect, a single element hydraulic open hole packer is provided comprising a piston for actuating said packer from an unset to a set position and a ratchet profile to maintain the packer in the set position once actuated, wherein both a setting stroke of the piston and a setting stroke of the ratchet profile are combined into one stroke. In a second aspect, a single element hydraulic open hole packer is provided comprising a ratchet ring assembled on a mandrel of the open hole packer.

A method is further provided for multistage isolation and fluid treatment of a borehole, the method comprising providing an apparatus for wellbore treatment including a liner, a first frac valve tool, a second frac valve tool upstream from the first frac valve tool along the liner, a first packer operable to seal about the liner and mounted on the liner downstream from the first frac valve tool, a second packer operable to seal about the liner and mounted on the liner between the first frac valve tool and the second frac valve tool, a third packer operable to seal about the liner and mounted on the liner upstream from the second frac valve tool, at least one of the first, second and third packers being a hydraulic set packer and at least one of the first, second and third packers having a single packing element, the first frac valve tool being moveable between a closed position and an open position permitting fluid flow through the first frac valve tool, the second frac valve tool moveable between a closed position and an open position permitting fluid flow through the second frac valve tool; running the liner into a wellbore in a desired position for treating the wellbore; hydraulically setting the single element packers; conveying means for moving the first frac valve tool to the open position; and forcing stimulation fluid out through the first frac sleeve tool.

DETAILED DESCRIPTION OF PREFERRED EMBODIMENTS

A packing tool is provided that improves on isolating tools by providing increased safety during installation, reduced rig time and greater dependability.

By combining both a slim outside diameter and short length, the present packing tool eliminates the need for handling pup joints, thereby reducing the rigidity of the liner. These features permit the more flexible, reduced outside diameter tool string to be deployed into the wellbore with greater ease.

The present packer is more preferably an open hole packer that can be deployed with corresponding fracing tools along a liner and deployed into the open hole section of the wellbore. The present packers provide a means of isolating various stages of the horizontal wellbore. Once isolated, stimulation fluid can be pumped from surface and used for stimulating sections of the formation via any variety of fracing tools.

Figure 1:
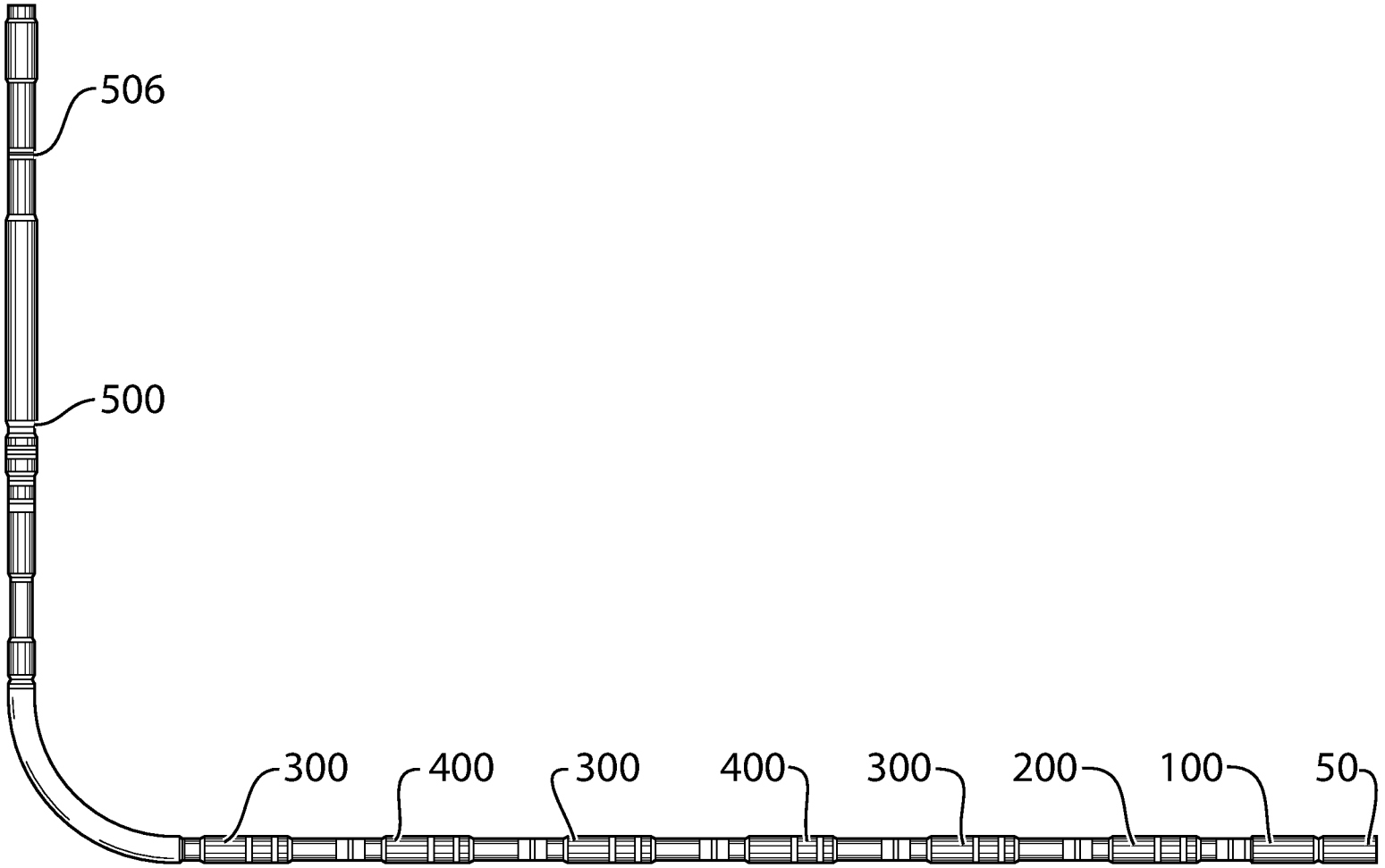
FIG. 1 is a schematic diagram of a horizontal well fitted with the tools of the present invention.

With reference to FIG. 1, in a preferred method of deployment, the present packers can be deployed on a tubing string further comprising a float shoe or guide 50 at the toe of the liner, an activation tool 100 at a pre-determined distance from the guide shoe 50, a first stage frac valve tool 200, and then a series comprising the present open hole packer 300 alternated with subsequent stage frac valve tools 400 to a final cased hole packer 500. It would be well understood by a person of skill in the art that FIG. 1 merely represents one example of a tubular fracing string of tools and that additions, omissions and alterations to the illustrated string and its components can be made without departing from the scope of the present invention.

The open hole packer 300 is illustrated on FIG. 2 in both an unset (a) and set (b) position. The present open hole packer 300 has a single packing element 328, differentiating it from other open hole packers that typically have dual elements and require multiple pistons to generate enough force to pack off the elements. A single pacing element 328 and single setting piston 302 allow the present open hole packer 300 to maintain its short length without requiring pup joints on either ends for handling.

The present open hole packer 300 being shorter, and slimmer in outside diameter (O.D.) than typical packers provides greater ease of deployment and string flexibility. Safety issues on the rig floor during installation are reduced by elimination of pup joints.

The present open hole packers 300 can be lifted by hand and hand threaded onto the liner, which is typically gripped at the rig floor, and then a section of upper liner, typically gripped in an elevator or similar device, can be lowered onto the open hole packer 300 and the one piece body of the packer 300 allows torque to be applied from the upper liner section, through the open hole packer 300 and into the liner to make up the liner string.

The present open hole packer 300, comprises a mandrel body 308 surrounded at least partially by a setting piston 302 and a single packing element 328. The setting piston 302 comprises a first and a second diameter, D1 and D2 respectively. While D1 is exposed to wellbore fluids and experiences wellbore pressures, D2 is exposed to fluid pressure from within the liner. The product of the difference in these pressures and the difference in these diameters defines the force needed to displace setting piston 302 and move the open hole packer 300 from an unset (a) to a set position (b). A pair of seals 312 between the setting piston 302 and the mandrel body 308 guide this movement from unset to set.

A ratchet ring 304 is located between the mandrel body 308 and the setting piston 302 that serves to prevent the piston 302 from backing off from a set position, thus ensuring that the packing element 328 remains in a set position once set. Instead of having separate stroke lengths for both the ratchet ring 304 and the sealing members 312 on the setting piston 302, the open hole packer's 300 novel design combines both features into one stroke.

In the present open hole packer 300 the ratchet ring 304 is preferably formed as a split ring with an inner surface ratchet profile and an outer surface ratchet profile. Preferably the inner surface ratchet profile is finer than the outer surface ratchet profile.

The ratchet ring 304 is first assembled onto the mandrel 308, at least a part of the outer surface of the mandrel 308 having a ratchet profile that mate with the inner surface ratchet profile of the ratchet ring 304. Preferably the ratchet ring 304 is assembled over one or more spring pins 306 installed on the mandrel 308 to control the position and alignment of the ratchet ring 304. A locking body thread 310 formed on an inner surface of part of the setting piston 302 is then installed over the ratchet ring 304. Preferably, the locking body thread 310 mates with the outer surface ratchet profile of the ratchet ring 304.

Typical packers have a ratchet ring installed into a locking thread of a piston. The locking body thread typically has spring pins installed in it to control the position and alignment of the ratchet ring relative to the piston. The piston with the ratchet ring must then be installed onto the mandrel body. This differs from the present invention in which the ratchet ring 304 is installed directly onto the mandrel 308 as the first stage of assembly.

An upset 320 on the mandrel 308, has a greater diameter than the diameter of the ratchet profile on the mandrel 308. In order to assemble the tool the ratchet ring 304 is first placed onto the mandrel 308 prior to the setting piston 302 being installed. In the present configuration both the setting stroke of the setting piston 302 and ratchet ring 304 are combined into one stroke, thereby allowing for a shorter length of open hole packer 300.

If the ratchet ring 304 and setting piston 302 had to be installed into the setting piston 302 first, then the diameter of the upset 320, D2, would need to be decreased, in turn causing a reduction in the setting area, defined by the difference between D2 and D1, of the setting piston 302. If the upset 320 was reduced then it could not house o-ring 312 and an independent stroke for the ratchet ring 304 and an independent stroke for the setting piston 302 would be required, which in turn would necessitate added length to the open hole packer 300.

Orientation of the inner surface ratchet profiles of the ratchet ring 304 allow the piston 302 and ratchet ring 304 to travel from unset to set position along the mandrel body, while preventing the piston 302 and ratchet ring 304 from sliding back to an unset direction from a set position. Orientation of the outer surface ratchet profile of the ratchet ring 304 allows the piston 302 to slide over the outer surface of the ratchet ring as it is being installed over the ratchet ring 304 and onto the mandrel 308. Once the locking body thread 310 and the outer surface ratchet profile of the ratchet ring 304 mate, these mating profiles lock the ratchet ring 304 to the piston 302 when the piston 302 moves from an unset to a set position.

The ratchet ring 304 and setting piston 302 have a larger ID than the mandrel 308, thereby being able to straddle the upset 320 on the mandrel 308 without having to split the locking body 310 from the setting piston 302.

The open hole packer 300 is full bore, with no internal mandrel restrictions. It has the same I.D. as the liner. The modular design of the open hole packer 300 permits several packers 300 to be stacked together with various distances between them. If the bore hole, for example dipped out of the formation of interest and entered an adjacent formation then was drilled back into the formation of interest, that section of the borehole that was outside the formation of interest could be isolated by placing an open hole packer 300 at both ends of the dip effectively straddling that portion of the borehole that was not in the formation of interest.

Figure 2A:
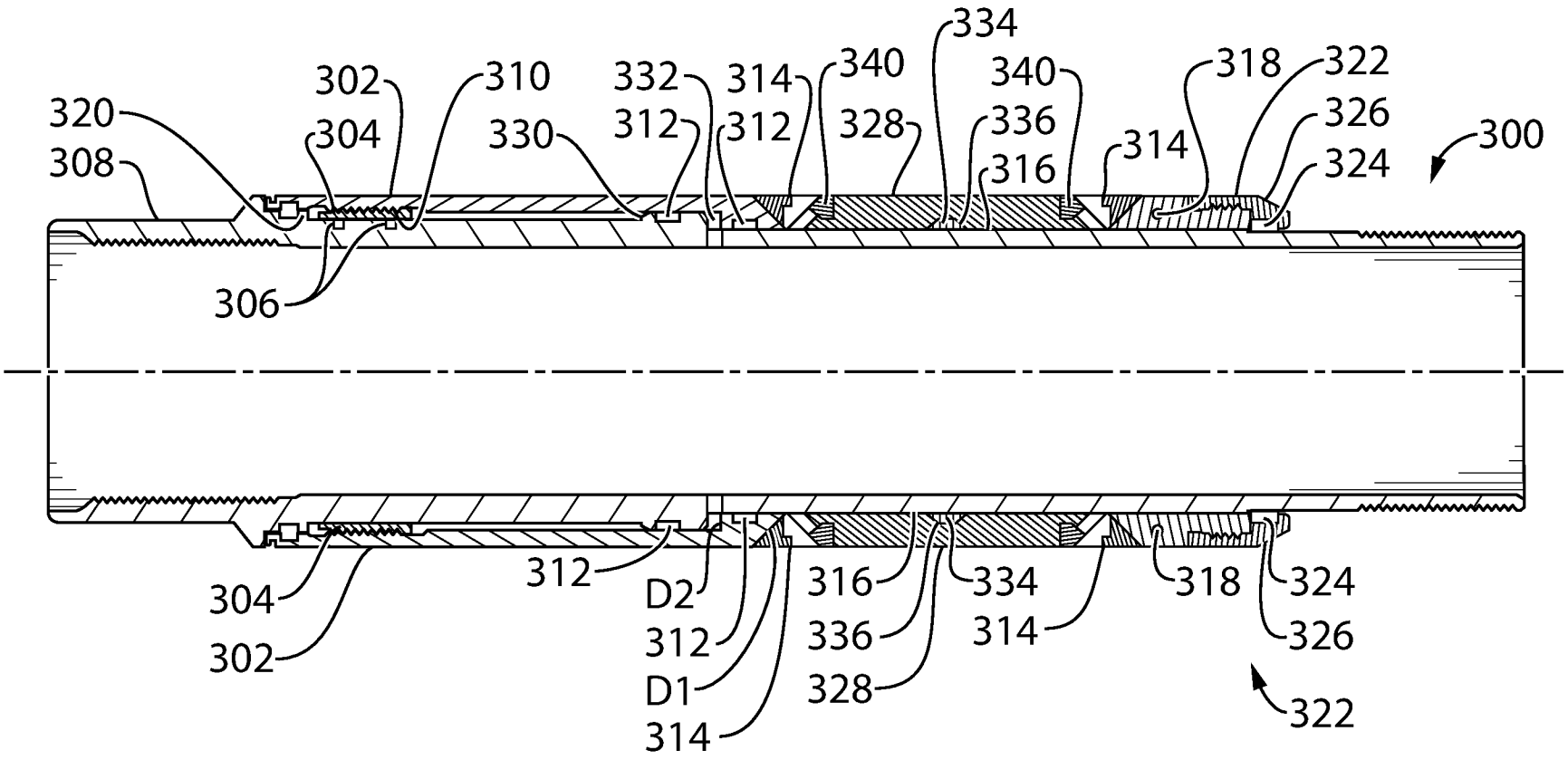
FIG. 2*a* is a cross sectional view of one example of the open hole packer of the present invention, in an unset position.
Figure 2B:
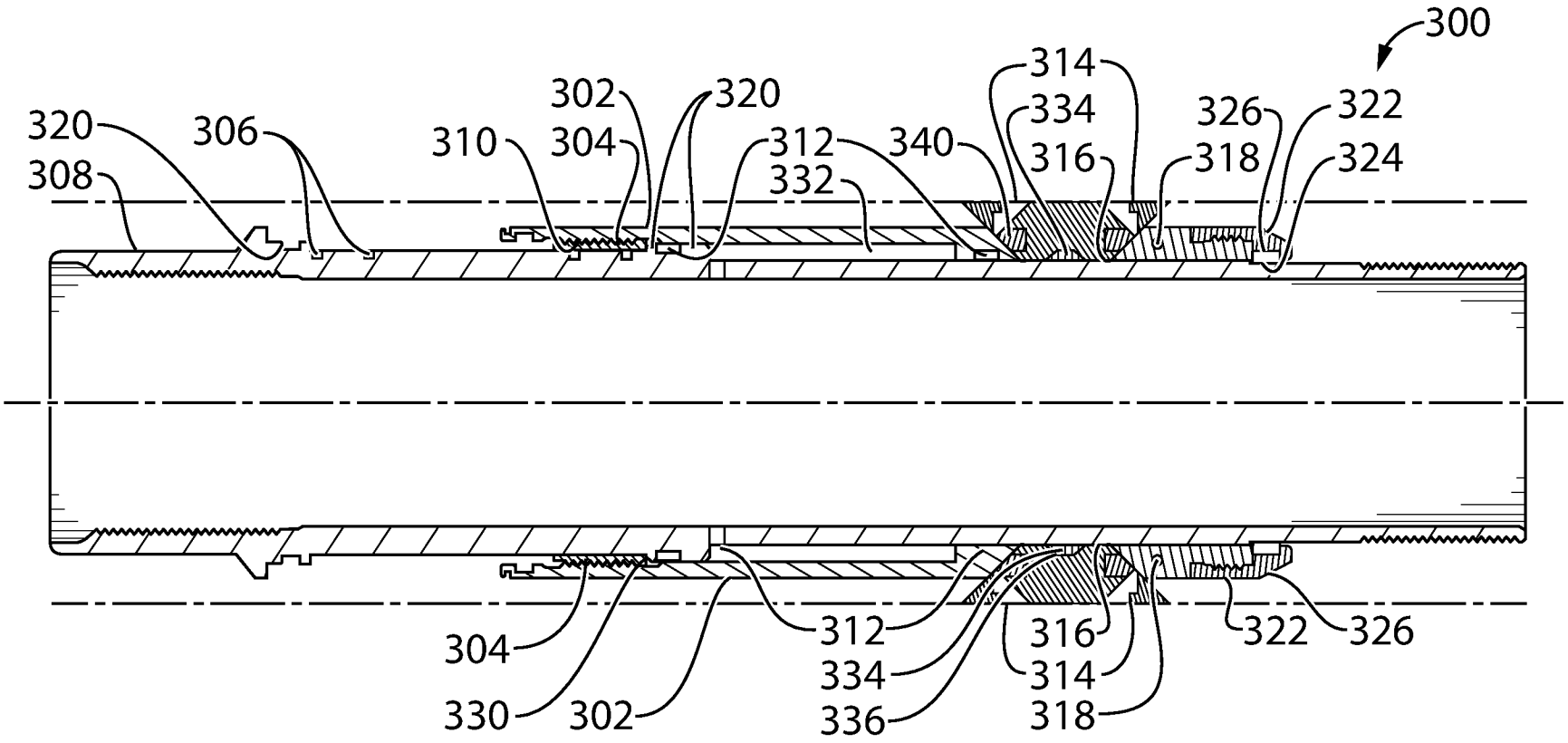
FIG. 2*b* is a cross sectional view of one example of the open hole packer of the present invention, in a set position.
Figure 3:
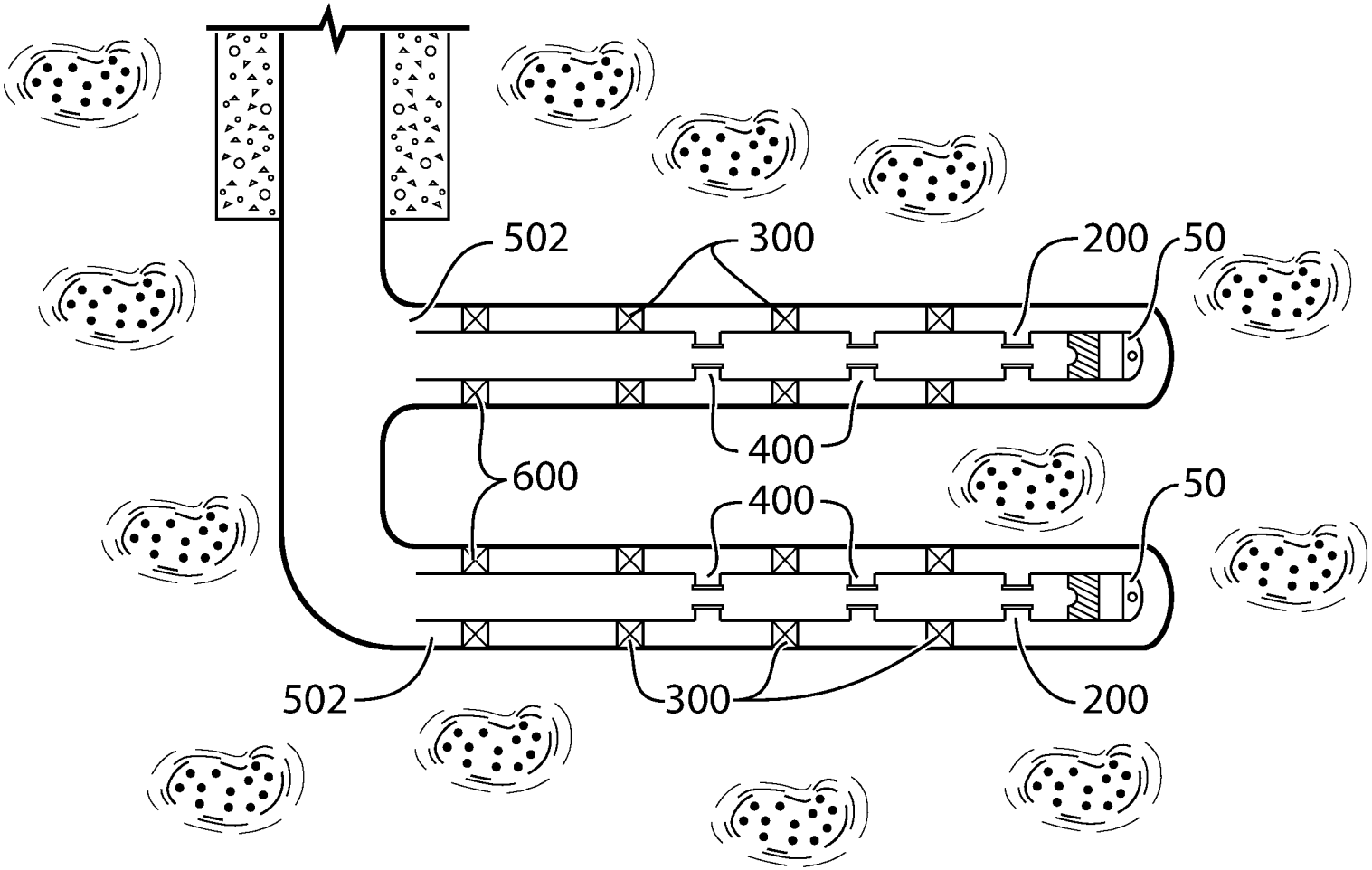
FIG. 3 is a schematic diagram of dual horizontals drilled in one well.

Preferably the present open hole packer 300 includes a stroke limiter 330 that acts to prevent the O-ring seals 312 on the setting piston 302 from disengaging the seal surface and opening up a leak path in the event that the open hole packer 300 is set in an oversize section of the bore hole. More preferably as seen in FIGS. 2*a* and 2*b*, the stroke limiter 330 is formed integrally as a surface of the upset 320.

Actuation of the packing element 328 is caused by movement of the setting piston 302 from an unset to a set position. The setting piston 302 and the mandrel 308 define an expandable chamber 332 into which pressurized fluid flows and pushes against piston diameter surface D2, thereby expanding chamber 332 and moving setting piston 302 into the set position. The setting piston 302 in turn presses against the packing element 328 causing packing element to protrude into the wellbore until it comes in to sealing contact with the open hole wall, thereby separating and isolating sections of the wellbore on either side of the packing element 328. The setting piston 302 is held in place and prevented from unsetting by ratchet ring 304.

The packing element 328 is comprised of a solid band of flexible material having a thickness such that an outer surface of the packing element 328 in its unset position sits flush with an outer surface of the setting piston 302. Suitable materials for the packing element include any number of fluorocarbons and per-flourocarbons such as AFLAS™, HNBR, and Viton™, although it would be understood by a person of skill in the art that any flexible material showing resiliency and sufficient strength to maintain packing against wellbore fluid pressure would be suitable for the purposes of the present invention.

In a preferred embodiment, the packing element 328 is thinner at its axial midpoint than everywhere else. More preferably, the packing element 328 is formed with a circumferential groove 336 of predetermined width and depth around its inner surface at the axial midpoint, such groove 336 creating a thinner middle portion of the packing element 328. The groove 336 ensures that the packing element 328 protrudes from its axial midpoint, thereby providing even contact with the wellbore and a positive seal. In a further preferred embodiment, a packing element ring 334 is provided on the mandrel 308 onto which the packing element groove 336 sits. The packing element ring 334 fills in the void of the groove 336 and ensures that the midpoint of the packing element 328 protrudes outwards upon actuation, and does not fold inwardly into itself.

One or more anti-extrusion expandable rings 314 hold the packing element 328 in place and press against the packing element 328 in actuation. More preferably, the anti-extrusion rings 314 are positioned between a backup ring 340 and the setting piston 302 at one end and between a further backup ring 340 and a lower cone 318 at a second end.

The anti-extrusion rings 314 are preferably tightly trapped to prevent them from toggling on the mandrel 308 during installation. This is eliminates the chance of a loose anti-extrusion ring 314 from catching on objects while being run in the hole and potentially causing the liner to get stuck.

The backup rings 340 is preferably shaped to allow an end of the setting piston 302 to travel along and wedge into one contour of the backup ring 340 while allowing the anti-extrusion ring 314 to travel along and wedge between the setting piston 302 and another contour of the backup ring 340. A similar travel and wedging effect occurs in relation to the lower cone 318 and anti-extrusion ring 314 on a second end of the packing element 328. Such wedging prevents the packing element 328 from extruding internally and prevents packing element creep during high differential pressures and helps centralize the open hole packer 300 while setting.

The anti-extrusion rings 314 and packing elements 328 are preferably held in glands 316. Tolerance accumulations on the anti-extrusion rings 314 and packing elements 328 create differences in the gland length 316, and these differences in length are preferably compensated for by an adjustment mechanism, generally indicated by 322, located adjacent the lower cone 318. The adjustment mechanism 322 more preferably comprises a split ring 324 having a series of circumferential grooves that mate with corresponding grooves on the mandrel body 308. The exact position of the split ring 324 is determined by the actual gland length 316 required by the anti-extrusion expandable rings 314 and packing element 328. A cap 326 is then threaded onto the lower cone 318, split ring 324 and mandrel body 308 to lock the adjustment mechanism 322 in place and set the gland length. The adjustment mechanism 322 ensures a tight fit of the anti-extrusion rings 314 to prevent them from toggling. Alternatively, a threaded cone may be employed in conjunction with a cap with a lock ring. In this embodiment the cap is anchored to the mandrel 308 and the adjustment can be made between the cone and the cap.

The interaction of the present anti-extrusion rings 314 and backup rings 340 creates a barrier around the packing elements 328 after the open hole packer 300 is set. Without this barrier the packing elements 328 would not be able to maintain a seal at high differential pressures in a large I.D. borehole. This interaction also advantageously eliminates the need for multiple packing elements on the open hole packer to handle such high differential pressures. The single element packer configuration in turn reduces the necessary length of the open hole packer 300, allowing it to be more easily installed and deployed.

The ability to successfully deploy the open hole packer 300 containing ant-extrusion rings 314 permits the tool to have a slim O.D., and still effectively seal off the annular space between the liner and the wellbore. The use of the ant-extrusion rings 314 is in turn possible due to the compensating mechanism 322 that accommodates fluctuations in gland length 316.

In one example of operation of the present open hole packers 300, a liner may be assembled with a float shoe 50, an activation tool 100, a liner, a first stage frac valve tool 200, and then a series comprising a liner, the present open hole packer 300, a liner and subsequent stage frac valve tools 400. Optionally, an open hole anchor 600 may be used between the activation tool 100 and the first stage frac valve tool 200 to anchor the liner to the wellbore. Alternative to an open hole anchor 600 centralizers, stabilizers or other suitable means known in the art may also be used for this purpose.

Preferably up to 40 frac valves 400, on a 4½" liner for example, separated with open hole packer 300*s* can be used in a string. A cased hole packer 500 is attached to the upper end of the liner. A latch seal assembly or other known means can be used to attach the cased hole packer 500 to the work string.

The liner is run into the conditioned bore hole by a work string or on a frac string. At a predetermined depth the activation tool 100 is activated to stop fluid flow. Pressure in the liner now increases from a triggering pressure at which both the cased hole packer 500 and the open hole packers 300 begin to set, to a final pack off pressure at which the cased hole packer 500 and open hole packers 300 are fully set. A pressure test may optionally be performed inside the casing to determine if the cased hole packer 500 has set properly. If the liner was run on a work string, the latch seal assembly or other connection means can next be removed from the cased hole packer 500 and the work string and latch seal assembly are removed from the well and a frac string and latch seal assembly are deployed. Otherwise, if the liner was run downhole on a frac string, no replacement has to be made.

Further pressure is applied to the fracture string. At a pre-determined setting pressure that is higher than the pack off pressure, the first stage frac valve tool 200 shifts to the open position and stimulation fluid is pumped into the formation and causes it to fracture. Proppant is then pumped into the fracture. Next subsequent frac valve tools, starting with that closest to the toe of the wellbore, are activated to thereby open communication between the inside of the liner and the isolated section of the formation between the two open hole packer 300 straddling the particular frac valve 400.

The stimulation fluid pumped through the frac valve 400 fractures the exposed formation between the open hole packers 300 used to isolate that stage. Whenever this stage has been fractured, a next frac valve 400 is activated and the process is repeated. The process can be repeated up to 40 times in total in a 4½" liner, for example. Other sizes of liners have a different number of frac valve tools 400 and open hole packers 300. When all the desired stages have been fractured the well is allowed to flow and formation pressure from formation fluid flow acts to deactivate the frac valves and allow formation fluid flow into the liner. Afterwards the frac string and connecting means can be removed from the well.

In the case of ball drop activated frac valve tools 400, if desired, the seats of the frac valves 400 can be drilled out at a later date.

In the event the operator needs to set the liner in an open hole, an open hole anchor 600 can replace the cased hole packer 500. This scenario can exist whenever dual horizontals are drilled in one well, as seen in FIG. 15. The hydraulic set open hole anchor 600 is full bore. It is run in conjunction with an open hole packer 300 and tie back receptacle (not shown) to act as a means to seal and anchor the liner in the open hole. The tieback receptacle provides a means to deploy the liner then act as a means to seal and anchor the fracture string to the liner.

The open hole anchor 600 is preferably full bore with no mandrel restrictions and has the same I.D. as the liner. Preferably it is operated with slips to anchor the liner to the formation.

Preferably, after the bore hole has been drilled and before the liner is installed, a reamer trip is performed. The present reamer has a unique design to mimic the geometry of the stiffest components on the liner string. The present reamer has one set of blades instead of multiple sets and its reduced O.D. and short length enable it to be deployed and retrieved quickly while still ensuring the bore hole has no obstructions to impede running the liner with the present suite of fracturing tools.

In the foregoing specification, the invention has been described with specific embodiments thereof; however, it will be evident that various modifications and changes may be made thereto without departing from the broader spirit and scope of the invention.

The invention claimed is:

1. A method for multistage isolation and fluid treatment of a borehole, the method comprising:

a. providing an apparatus for wellbore treatment including:
   - a liner,
   - a first frac valve tool,
   - a second frac valve tool upstream from the first frac valve tool along the liner,
   - a first packer operable to seal about the liner and mounted on the liner downstream from the first frac valve tool, the first packer comprising:
     - a mandrel;
     - a packing element;
     - a setting piston for actuating the first packer;
     - a ratchet profile to maintain the first packer in a set position once actuated;
     - a backup ring;
     - an anti-extrusion expandable ring positioned between the packing element and the backup ring; and
     - an adjustment mechanism engaged with a set of grooves on the mandrel;
   - a second packer operable to seal about the liner and mounted on the liner between the first frac valve tool and the second frac valve tool,
   - a third packer operable to seal about the liner and mounted on the liner upstream from the second frac valve tool,
   - wherein at least one of the first, second and third packers being a hydraulic set packer,
   - wherein the first frac valve tool is moveable between a closed position and an open position permitting fluid flow through the first frac valve tool, and
   - wherein the second frac valve tool is between a closed position and an open position permitting fluid flow through the second frac valve tool;

b. running the liner into a wellbore in a desired position for treating the wellbore;

c. hydraulically setting the single element packers;

d. conveying means for moving the first frac valve tool to the open position; and e. forcing stimulation fluid out through the first frac sleeve tool.

2. The method of claim 1 wherein at least one of the first, second and third packers are open hole packers.

3. The method of claim 1, further comprising the steps of:

f. conveying means for moving the second frac valve tool to the open position; and g. forcing stimulation fluid out through the second frac valve tool.

4. A method for multistage isolation and fluid treatment of a borehole, the method comprising:

a. providing an apparatus for wellbore treatment the apparatus comprising:
   - a liner,
   - a first frac valve tool,
   - a second frac valve tool upstream from the first frac valve tool along the liner,
   - a first packer operable to seal about the liner and mounted on the liner downstream from the first frac valve tool, wherein the first packer further comprises:
     - a mandrel;
     - a packing element;
     - a setting piston for actuating the first packer;
     - a ratchet profile to maintain the first packer in a set position once actuated;
     - a backup ring;
     - an anti-extrusion expandable ring positioned between the packing element and the backup ring; and
     - an adjustment mechanism engaged with a set of grooves on the mandrel;

a second packer operable to seal about the liner and mounted on the liner between the first frac valve tool and the second frac valve tool, a third packer operable to seal about the liner and mounted on the liner upstream from the second frac valve tool, wherein at least one of the first, second and third packers being a hydraulic set packer, wherein the first frac valve tool is moveable between a closed position and an open position permitting fluid flow through the first frac valve tool, and wherein the second frac valve tool is moveable between a closed position and an open position permitting fluid flow through the second frac valve tool;

b. running the liner into a wellbore in a desired position for treating the wellbore;

c. hydraulically setting the first packer, wherein both a setting stroke of the setting piston and a setting stroke of the ratchet profile are combined into one stroke;

d. conveying means for moving the first frac valve tool to the open position; and e. forcing stimulation fluid out through the first frac sleeve tool.

* * * * *